US005158275A

United States Patent [19]

Sellers et al.

[11] Patent Number: 5,158,275

[45] Date of Patent: Oct. 27, 1992

[54] MULTIPLE TRAY ROTARY PAPER FEED SYSTEM FOR AN IMAGE REPRODUCTION MACHINE

[75] Inventors: Charles A. Sellers, Houston; Steve J. Lau, Tomball, both of Tex.

[73] Assignee: Compaq Computer Corporation, Houston, Tex.

[21] Appl. No.: 721,199

[22] Filed: Jun. 26, 1991

[51] Int. Cl.[5] ..... B65H 3/44

[52] U.S. Cl. ..... 271/9; 271/126; 271/162

[58] Field of Search ..... 271/9, 126, 241, 145, 271/147, 157, 158, 162, 164

[56] References Cited

U.S. PATENT DOCUMENTS

| | | | |
|---|---|---|---|
| 2,172,519 | 9/1939 | Reeder | 271/147 |
| 4,451,191 | 5/1984 | Torre | 271/9 |
| 4,763,890 | 8/1988 | Zimmerman et al. | 271/9 |
| 5,002,267 | 3/1991 | Brecy | 271/9 |

FOREIGN PATENT DOCUMENTS

| | | | |
|---|---|---|---|
| 0370836 | 5/1990 | European Pat. Off. | 271/9 |
| 0262735 | 12/1985 | Japan | 271/145 |

*Primary Examiner*—H. Grant Skaggs
*Attorney, Agent, or Firm*—Konneker & Bush

[57] ABSTRACT

A paper feed system for an image reproduction machine, representatively a printer, has a shelf member disposed within the machine housing and rotatably carrying a turntable on its upper side. Two transversely oriented pairs of diametrically opposite upper and lower paper trays are removably supported on the turntable, with portions of the upper trays overlying the lower trays. The turntable may be rotated to vertically interpose a selected one of the four trays between a stationary picker roller and a lifter structure positioned beneath the picker roller. The lifter structure has a portion which moves upwardly through a shelf opening, and a turntable opening aligned therewith, to engage the selected tray and lift it toward the picker roller to bring a paper stack held in the tray into engagement with the picker roller which operates to successively remove sheets from the stack and deliver them to the machine's paper feed path. The lifter structure may then be lowered to return the selected tray to its initial position on the turntable and permit another tray to be selected for rotation into a position from which it may be lifted to the picker roller. When a lower tray is selected, a shift mechanism is operated to move the upper trays out of the lift path of the selected lower tray. The trays may be accessed by operating a drive motor which drives the turntable shelf horizontally outwardly through a housing side wall access opening.

17 Claims, 3 Drawing Sheets

MULTIPLE TRAY ROTARY PAPER FEED SYSTEM FOR AN IMAGE REPRODUCTION MACHINE

BACKGROUND OF THE INVENTION

1. Field of the Invention

The present invention relates generally to image reproduction machines, and more particularly relates to paper supply feed systems for image reproduction machines such as printers and copiers.

2. Description of Related Art

It is conventional practice to provide image reproduction machines, such as printers and copiers, with a paper feed supply tray configured to hold a stack of cut paper sheets. The paper-filled tray is typically inserted into an appropriate slot formed in the machine housing to position the paper stack adjacent a picker roller assembly which is selectively operable to sequentially feed the paper sheets, top sheet first, into the paper feed path of the machine. To accomplish this task, the picker roller portion of the assembly is normally positioned above the top paper sheet in the stack, and is movable downwardly into frictional engagement therewith and rotationally drivable to move the top sheet into the feed path.

To enlarge the overall supply paper holding capacity in image reproduction machines of this general type, and/or permit the use of different sized paper sheets therein without reloading, various proposals have been previously made to provide printers and copiers with a plurality of paper feed trays which may be operatively inserted into corresponding slots in the machine housing in a vertically stacked and mutually spaced apart relationship. In this manner, the paper sheets in any selected one of the various trays may be fed into the machine, thereby permitting much longer printing runs without reloading a paper tray (when two or more of the trays are loaded with the same size paper), or permitting changes in the paper size being fed into the machine without changing out the paper size in a tray (when different size paper is loaded into two or more of the trays).

While this vertical stacking of multiple paper feed trays is a conventional and widely accepted practice, it is subject to several well known problems, limitations and disadvantages. For example, using this vertically stacked feed tray arrangement has heretofore required a separate picker roller assembly for each paper tray-a requirement adding considerable complexity and additional fabrication cost to the overall image reproduction machine.

Moreover, this conventional stacked tray configuration can require an undesirable, and otherwise unnecessary, height increase in the machine housing. This is due to the fact that each picker roller assembly must be disposed directly above the top sheet of paper in its associated paper feed tray, and directly beneath the next higher tray in the stack. Accordingly, for example, if there are four vertically stacked trays, each having an associated picker roller assembly, the total tray/picker roller assembly height required would be 4T+4P, "T" being the height of each tray, and "P" being the total vertical distance required for each picker roller assembly. Further, it is typically necessary to route the paper sheets picked from the individual, vertically spaced paper stacks through different paper feed paths in the machine housing, thereby additionally increasing the overall complexity and fabrication cost of the image reproduction machine.

It can readily be seen from the foregoing that it would be desirable to provide an image reproduction machine, such as a printer or copier, with an improved multiple tray paper feed system which eliminates or at least substantially reduces the above-mentioned problems, limitations and disadvantages heretofore associated with vertically stacked paper tray systems of the general type described above.

SUMMARY OF THE INVENTION

In carrying out principles of the present invention, a representative image reproduction machine is provided with a specially designed multiple tray rotary paper feed system of a vertically compact configuration. The image reproduction machine, which could be a printer or a copier, includes printing means for forming a predetermined image on a sheet of paper delivered thereto; paper feed path means for receiving a sheet of paper and delivering it to the printing means; and picker means for successively removing sheets of paper from a paper stack brought upwardly into engagement with an underside portion thereof and delivering the removed paper sheets to the paper feed path means.

From a broad perspective, the multiple tray rotary paper feed system comprises a plurality of paper trays each adapted to hold a stack of paper sheets, and support means for supporting the trays, at levels lower than that of the picker means, in a circumferentially spaced array centered about a vertical axis extending through the support means and horizontally offset from the picker means.

Drive means are provided for rotating the support means about the vertical axis to move a selectively variable one of the paper trays into an underlying relationship with the picker means, and lifter means are operative to lift the paper tray underlying the picker means from the support means in a manner bringing a paper stack held in the lifted paper tray into operative engagement with the picker means, and subsequently lower the lifted paper tray back onto the support means.

In a preferred embodiment of the paper feed system, the support means include a shelf mounted in the machine housing for horizontal sliding movement between a use position in which a rear side edge portion of the shelf, which has an opening extending vertically therethrough, underlies the picker means, and an access position in which a front side edge portion of the shelf extends outwardly through an access opening formed in a front side wall portion of the housing. A turntable is rotatably mounted on the top side of the shelf and has four openings extending vertically therethrough and circumferentially spaced apart 90° from one another. Means are provided for rotationally driving the turntable to position a selectively variable one of its openings in an aligned, overlying relationship with the shelf opening.

Two lower paper trays are supported in recesses in the turntable which extend around a diametrically opposite pair of its openings. Two upper paper trays are mounted in openings formed in a support tray positioned above the lower paper trays, with the upper paper trays overlying the other two turntable openings. The support tray is horizontally shiftable out of the lift path of either of the two lower paper trays, and means are provided for temporarily shifting the support tray in this manner when one of the lower paper trays is selected for lifting to the picker means.

The lifter means in the preferred embodiment of the paper feed system include a plate member configured to be passed upwardly through the shelf opening and an overlying turntable opening, and a plurality of elongated lifter members interconnected for scissors-like pivotal motion relative to one another between a lowered position in which the lifter members are in a generally horizontal orientation, and a raised position in which the lifter members are generally vertically disposed. Means are provided for connecting the lifter members to the plate member in a manner moving it upwardly through the shelf and overlying turntable opening, into lifting engagement with the selected paper tray, as the lifter members are pivoted toward their raised position, and moving it downwardly through the aligned turntable and shelf openings as the lifter members are pivoted toward their lowered position. Means are additionally provided for pivotally driving the lifter members between their raised and lowered positions.

With the support shelf moved to its use position within the machine housing, the preferred embodiment of the rotary paper feed system is utilized by rotationally driving the turntable to position a selected one of the four paper trays, and its underlying turntable opening, over the shelf opening. If one of the two lower paper trays has been selected, the upper support tray is temporarily shifted horizontally out of its lift path.

The lifter means are then operated to move the lifter plate member upwardly through the shelf opening, and the overlying turntable opening, into engagement with the underside of the selected paper tray to operatively lift it to the picker means. The lifted tray may be subsequently lowered back onto the turntable, or the support tray as the case may be, to permit the selection and lifting of another of the three paper trays.

Compared to a conventional four tray paper feed system, in which the paper trays are vertically stacked one above the other, and each provided with a separate picker assembly overlying its associated paper stack, the preferred four tray embodiment of the present invention's rotary paper feed system, which may be served by a single picker assembly, has a desirably reduced vertical height. This height reduction, in turn, also reduces the total height required for the outer housing portion of the image reproduction machine.

BRIEF DESCRIPTION OF THE DRAWINGS

FIGS. 4–7 are reduced scale schematic top plan views of the paper feed system which sequentially illustrate its operation;

FIGS. 4A–7A are side elevational views of the paper feed system as respectively depicted in FIGS. 4–7; and FIG. 8 is an enlarged perspective view of one of the system's four paper feed trays being elevated by a lifter portion of the system.

DETAILED DESCRIPTION

Figure 1:
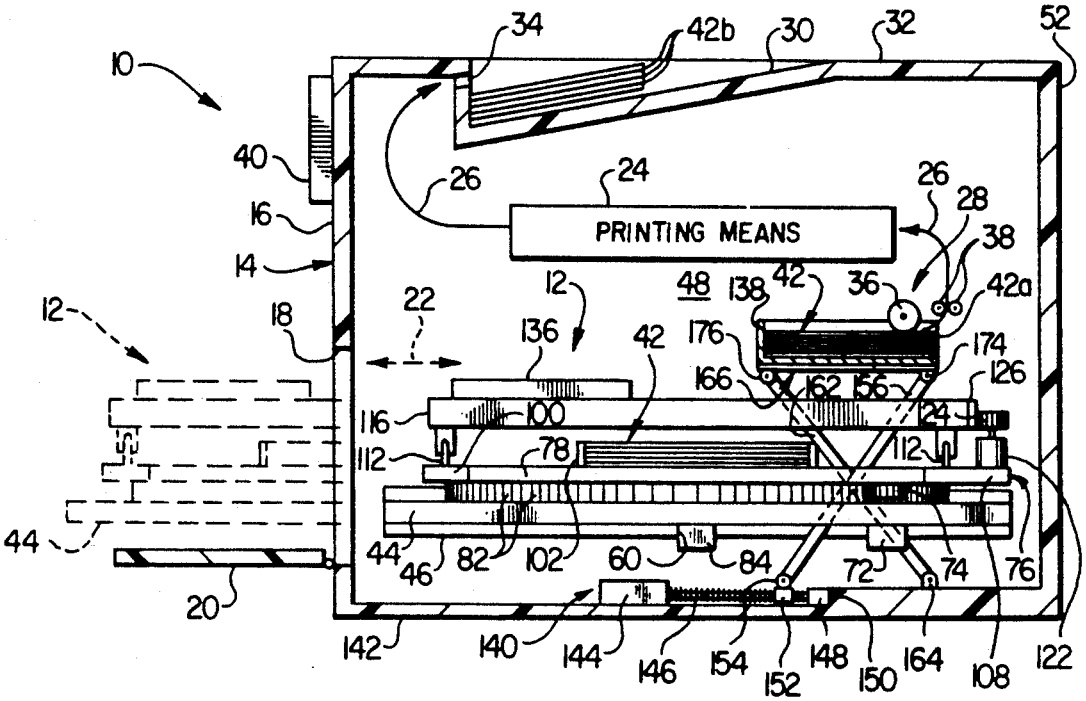
FIG. 1 is a simplified, somewhat schematic cross-sectional view through a representative image reproduction machine having incorporated therein a multiple tray rotary paper feed system embodying principles of the present invention.

Cross-sectionally illustrated in FIG. 1, in a somewhat simplified and schematic fashion, is an image reproduction machine, representatively in the form of a printer 10 (although the machine could alternatively be a copier), having incorporated therein a specially designed multiple tray rotary paper feed system 12 embodying principles of the present invention. The paper feed system 12 is positioned within a printer housing portion 14 having a front wall 16 in which an access opening 18 formed therein and normally covered by a swing-down access panel 20 pivotally connected to housing wall 16. In a manner subsequently described, the paper feed system 12 is slidable outwardly through the wall opening 18, from the system's solid line use position to its dotted line access position 12, as indicated by the dashed arrow 22.

Printer 10 also includes schematically depicted printing means 24 which are conventionally interposed in a paper feed path 26 disposed within the housing 14 and extending between a conventional picker roller assembly 28 and a recessed paper-receiving well area 30 formed in the top housing wall 32 and having a paper passage slot 34 formed therein. The paper feed path 26 forms a portion of conventional paper transport means operative to receive a sheet of paper and deliver it to the printing means 24. The picker roller assembly 28 is stationarily positioned within housing 14 above the rotary feed system 12 and includes a picker roller 36 which operates in conjunction with a pair of pinch rollers 38 to the right thereof.

The cooperative operation of the rotary feed system 12, the picker roller assembly 28 and the printing means 24 may be initiated and regulated by the operation of suitable control means, the actuation portions of which are disposed on a control panel 40 mounted on the front housing wall 16. In a manner subsequently described, during operation of the printer 10 a stack 42 of cut paper sheets spaced downwardly apart from the picker roller assembly 28 is moved upwardly within the housing 14 until the top sheet $42_a$ in the stack is pressed against the underside of the picker roller 36.

The picker roller assembly 28 then removes the paper sheet $42_a$ from the stack 42 and delivers the removed sheet, via the paper feed path 26, to printing means 24 which functions in a conventional manner to form a predetermined image on the sheet. The now imprinted sheet $42_b$ leftwardly exiting the printing means 24 is then passed through the remainder of the feed path 26, and the paper slot 34, and falls atop a stack of previously printed sheets $42_b$ in the top well area 30.

Figure 2:
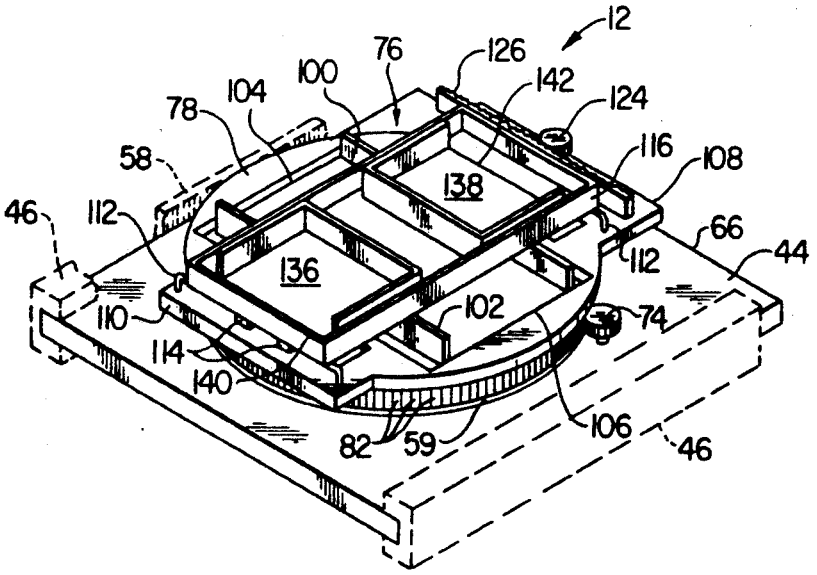
FIG. 2 is an enlarged scale, partially phantomed perspective view of the paper feed system.
Figure 3:
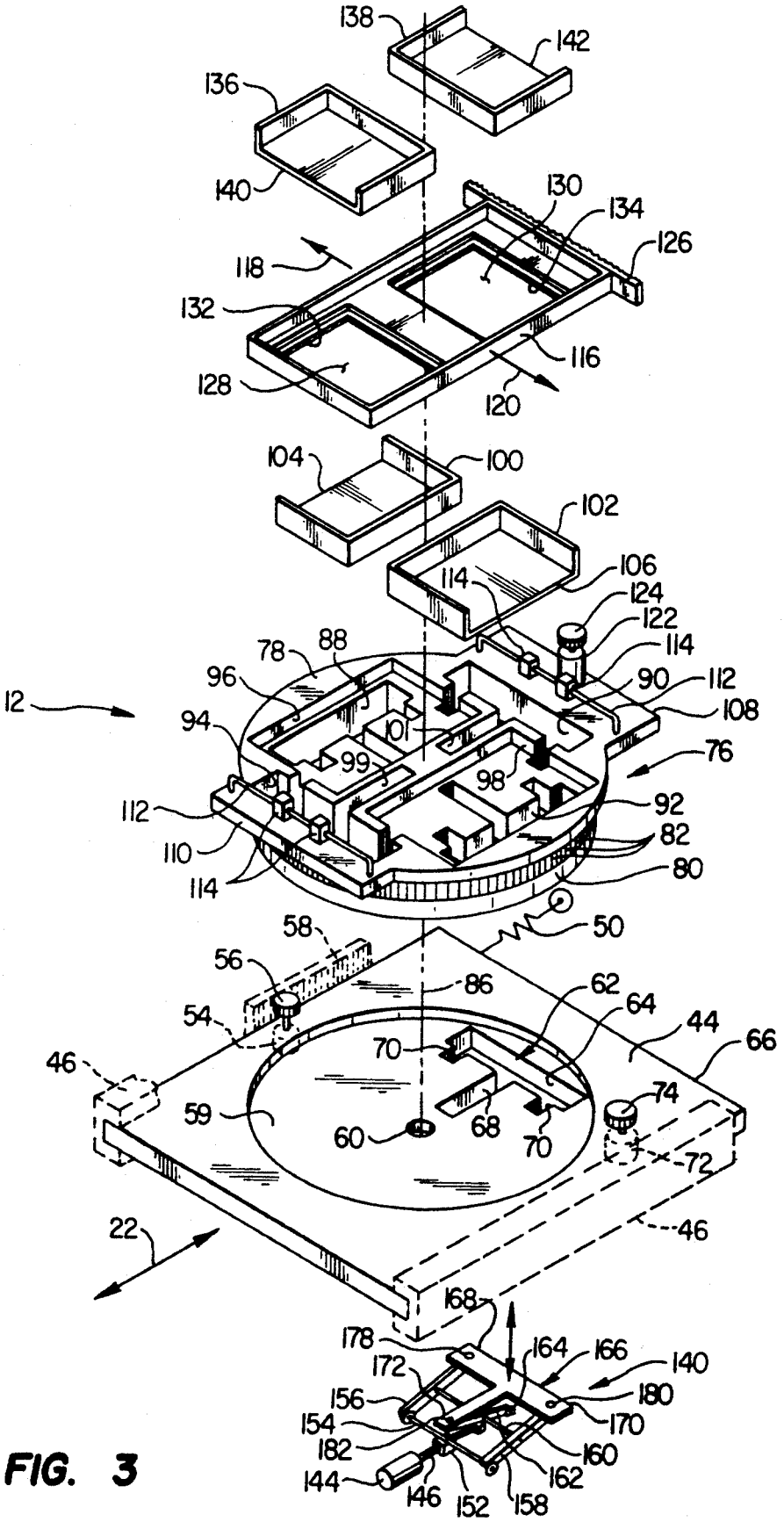
FIG. 3 is an exploded perspective view of the paper feed system.

Referring now to FIGS. 1–3, the multiple tray rotary paper feed system 12 of the present invention includes a rectangular shelf member 44 having opposite side edge portions thereof slidably received in support bracket structures 46 interiorly mounted on opposite housing side walls 48. This permits the shelf 44 to slide leftwardly out the housing access opening 18, and rightwardly back to its solid line use position (FIG. 1).

Shelf 44 is rightwardly biased toward its use position by a tension spring member 50 (FIG. 3) connected at its opposite ends to the rear side edge of shelf 44 and the rear housing side wall 52. An electric motor 54 (FIG. 3) is secured as illustrated to a left side edge portion of the shelf 44 and is utilized to horizontally drive the shelf between its access and use positions. To selectively effect this horizontal shelf movement, a pinion gear 56 is secured to the motor output shaft and operatively meshes with a horizontal gear rack member 58 interiorly supported on one of the housing side walls 48.

A central circular depression 59 (FIG. 3) is formed in the top side of shelf 44, the periphery of the depression coaxially circumscribing a small circular aperture 60 extending vertically through the shelf. For purposes subsequently described, a generally T-shaped slot 62 is formed through the depressed area 59 of the shelf rearwardly of the central aperture 60. As illustrated in FIG. 3, the slot 62 has a radially outer section 64 which extends parallel to the rear side edge 66 of shelf 44, and a central section 68 which extends radially inwardly from the slot section 64. For purposes subsequently described, the slot section 64 is provided with two relatively short forwardly extending portions 70 adjacent its outer ends. Also for purposes subsequently described, an electric motor 72 is mounted as illustrated on a right side edge portion of the shelf 44 and has a pinion drive gear 74 secured to the upper end of its drive shaft.

Rotatably supported on the top side of the slidable shelf 44 is a turntable structure 76 including a generally disc-shaped body portion having an upper side section 78, a lower side section 80, and a vertically intermediate section having a series or radially outwardly projecting gear teeth 82 circumferentially spaced around its periphery. The upper side section 78 of the turntable body is rotatably received in the shelf depression 59 (FIG. 2), with a depending guide pin portion 84 (FIG. 1) being received in the central shelf aperture 60. As illustrated in FIG. 2, the pinion drive gear 74 meshes with the turntable gear teeth 82, thereby permitting the turntable to be rotationally driven relative to the shelf 44, about the vertical axis 86 shown in FIG. 3, by operation of the electric motor 72.

Four generally T-shaped slots 88,90,92 and 94 (FIG. 3) extend vertically through the turntable body, with each of these four turntable slots having a size and shape substantially identical to the size and configuration of the previously described shelf slot 62. Turntable slots 88,90,92 and 94 are circumferentially spaced at 90° intervals from one another on the turntable, with the slot pairs 88,92 and 90,94 being diametrically opposite from one another.

Slots 88 and 92 respectively extend through a diametrically opposite pair of elongated rectangular recesses 96,98 formed in the top side surface of the upper side section 78 of the turntable body, with the radially inwardly projecting sections 99, 101 of the slots 90 and 94 being positioned between the recesses 96,98. By suitably operating the electric motor 72, the turntable may be rotated to position any selected one of the four turntable slots 88,90,92 or 94 directly over and in precise horizontal alignment with the shelf slot 62 for purposes later described.

As may be seen by comparing FIGS. 2 and 3, a pair of elongated rectangular lower paper trays 100 and 102, having oppositely facing open sides 104 and 106, are removably and complementarily received and supported within the recesses 96 and 98, respectively. Each of the trays 100, 102 is sized to hold a stack 42 of cut paper sheets, with the long dimension of the paper sheets extending parallel to the length of its associated tray.

The upper turntable body section 78 has a diametrically opposite pair of radially outwardly projecting support tab portions 108 and 110 respectively positioned just outwardly of the turntable slots 90 and 94. Mounted on the top sides of tabs 108, 110 are a pair of elongated, elevated support rod structures 112, each of which has a pair of block members 114 slidably carried thereon. The top sides of blocks 114 are secured to the undersides of opposite end portions of an elongated rectangular support tray 116 which, in its central position illustrated in FIG. 2, overlies opposing side portions of the lower paper trays 100 and 102.

Support tray 116, due to its securement to the slidably mounted blocks 114, may be horizontally shifted leftwardly or rightwardly away from its central position, as indicated by the arrows 118 and 120 in FIG. 3, to permit a selected one of the lower paper trays 100, 102 to be lifted straight out of its associated turntable recess and moved upwardly beyond the level of the support tray 116. Such leftward and rightward horizontal shifting of the support tray 116 away from its central position illustrated in FIG. 2, in which the support tray overlies and blocks the upward movement of the lower paper trays 100 and 102, is effected by the operation of an electric motor 122 mounted on the right turntable tab 108.

Motor 122 has a pinion drive gear 124 mounted on the upper end of its drive shaft and meshed with the teeth of a horizontal gear rack member 126 secured to the right end of the support tray 116. Accordingly, when gear 124 is rotated in a counterclockwise direction as viewed in FIG. 2, the support tray 116 is shifted rightwardly from its central position to permit the lower paper tray 100 to be lifted vertically out of its turntable recess 96 and upwardly past the shifted support tray. Conversely, when gear 124 is rotated in a clockwise direction, the support tray 116 is shifted leftwardly from its central position to permit the lower paper tray 102 to be lifted vertically out of its turntable recess 98 and upwardly past the shifted support tray.

The support tray 116 has a pair of elongated rectangular openings 128 and 130 spaced apart along the length of the tray and being peripherally bordered by ledge portions 132 and 134 as shown in FIG. 3. A pair of elongated rectangular upper paper trays 136 and 138, having forwardly and rearwardly facing open sides 140 and 142, are respectively received in the support tray openings, rest upon the ledges 132 and 134, and may lifted upwardly out of the support tray openings 128 and 130. Like their lower tray counterparts, the upper paper trays 140, 142 are each adapted to hold a stack 42 of cut paper sheets, with the long dimensions of the sheets extending parallel to the length of their associated upper paper tray.

As can be best seen in FIG. 2, relative to the periphery of the turntable structure 76 each of the four paper trays 100, 102, 136 and 138 is circumferentially offset by an angle of 90° from the two paper trays circumferentially adjacent thereto, with the open sides of the paper trays facing in a radially outward direction relative to the turntable structure. Stated in another manner, relative to a circle lying in a horizontal plane and centered about the vertical turntable axis 86 (FIG. 3), tray 102 is circumferentially offset 90° in a clockwise direction from tray 138; tray 136 is circumferentially offset 90° in a clockwise direction from tray 102; tray 100 is circumferentially offset 90° in a clockwise direction from tray 136; and tray 138 is circumferentially offset 90° in a clockwise direction from tray 100.

Referring now to FIGS. 1 and 3, the rotary paper feed system 12 of the present invention also includes a tray lifting structure 140 which is interiorly secured to the bottom housing wall 142, beneath the shelf 44, and is movable in a manner subsequently described between a raised position shown in FIG. 1 and a lowered position shown in FIG. 3. Lifter structure 140 includes an electric motor 144 secured to housing wall 142 and operative to rotationally drive a horizontal lead screw 146 rotatably supported at its right end by a block member 148 positioned against an interior abutment portion 150 of the bottom housing wall 142. A drive nut 152 is mounted on the lead screw 146 for horizontal driven movement in response to rotation of the screw.

A rod 154 extends transversely to the lead screw 146 and has a central portion thereof anchored to the top side of the drive nut 152. As best illustrated in FIG. 3, the outer ends of the rod 154 are pivotally connected to the inner ends of a pair of elongated lifting bars 156 and 158, longitudinally intermediate portions of which are interconnected by a rod 160. Rod 160 is pivotally extended through a longitudinally intermediate portions of an elongated lifting bar 162 having an inner end pivotally secured to the bottom housing wall 142, as at 164, to the right of the block member 148.

The tray lifting structure 140 also includes a horizontally disposed, generally T-shaped lifting plate member 166 having outer end portions 168, 170 and 172. For purposes subsequently described, these outer end portions 168, 170 and 172 have small, generally dome-shaped protrusions 178, 180 and 182 respectively formed on their upper side surfaces. Plate member 166 is configured in a manner such that it may be passed upwardly through the similarly configured shelf slot 62. The outer ends of the lifting bars 156, 158 are pivotally connected, as at points 174, to the undersides of the plate member outer end portions 168 and 170, and the outer end of the lifting bar 162 is fitted with a roller member which rollingly engages the underside of the plate member end portion 172.

Figures 4, 4A, 5, 5A, 6, 6A, 7, 7A, 8:
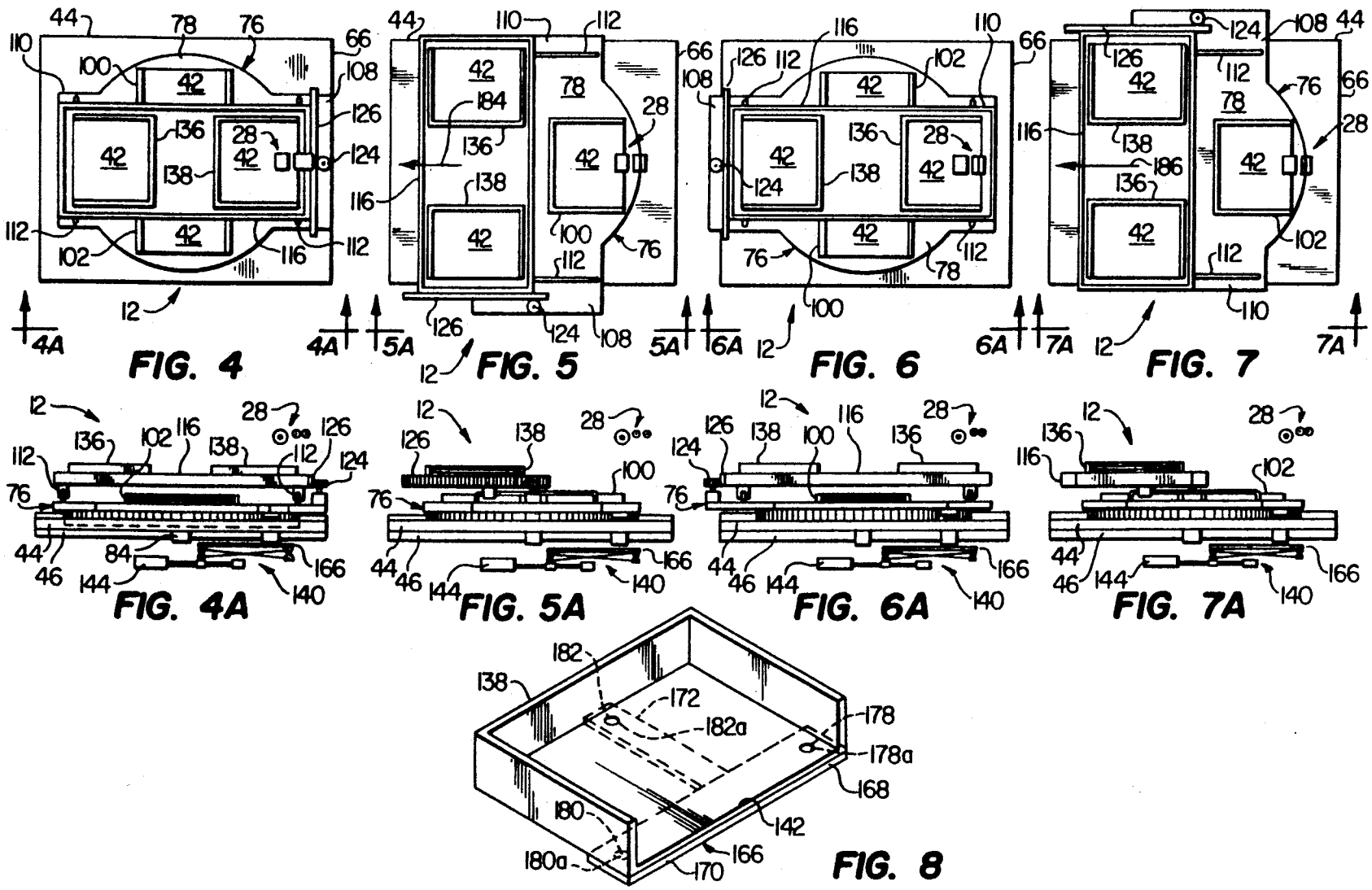

The unique operation of the rotary paper feed system 12 will now be described. To establish a starting point, it will be assumed that (as shown in FIGS. 1, 4 and 4A)) each of the paper trays 100, 102, 136 and 138 has been loaded with a paper stack 42; that the tray lifting structure 140 is in its lowered position; that the shelf 44 has been horizontally moved to its use position within the housing 14; and that the turntable structure 76 is in a rotational orientation relative to shelf 44 such that the upper paper tray 138 is positioned beneath the picker roller assembly 28, with the turntable slot 90 positioned above and aligned with the shelf slot 62.

In this representative starting orientation, the lowered lifting plate member 166 is disposed beneath and horizontally aligned with the shelf slot 62 (FIG. 3). To raise the paper stack 42 into operative engagement with the picker roller 36, as depicted in FIG. 1, the lead screw 146 is rotated in an appropriate direction by motor 144 to cause a rightward driven movement of the drive nut 152 from its FIG. 3 starting position. This, in turn, causes the lifting bars 156, 158 to vertically scissor apart from the central lifting bar 162 (as may be seen by comparing FIGS. 2 and 3) and lift the plate member 166 along an essentially linear vertical travel path from its lowered starting orientation.

Further vertical scissoring action of the lifting bars causes the lifting plate 166 to sequentially pass upwardly through the shelf slot 62 (FIG. 3) and the turntable slot 90, move upwardly past the lower paper trays 100 and 102, and then upwardly through the support tray opening 130 into engagement with the underside of the upper paper tray 138. As the lifting plate 166 engages the tray 138, the previously mentioned protrusions 178, 180 and 182 on the upper side of plate enter complementarily configured depressions **178*a*, 180*a* and 182*a* formed on the underside of the tray 138**. The other three paper trays have similar depressions formed on their undersides.

As illustrated in FIG. 1, further upward movement of the lifting plate 166 lifts tray 138 out of its support tray opening 130 and brings the top paper sheet **42*a* into operative engagement with the picker roller 36 which then may be rotated to feed the sheet 42*a*, and subsequent underlying sheets, into the paper feed path 26. As the lifting bars 156, 158 continue their upward pivoting movement, upper portions thereof enter the shelf slot portions 70 (and the corresponding portions of the particular turntable slot which overlies the shelf slot) to prevent interference between the lifting bars 156, 158** and the shelf and turntable portions of the paper feed system.

During its upward movement toward the picker roller 36, the tray 138 is horizontally stabilized by the interengagement between the lifting plate protrusions 178, 180 and 182 and the tray depressions **178*a*, 180*a* and 182*a***. A similar horizontal stabilization is achieved for the other paper trays when they are lifted to the picker assembly as later described herein.

When it is desired to terminate the paper feed from the tray 138, and switch to another paper tray as later described, the lead screw 146 is simply rotated in the opposite direction to downwardly move the lifting plate 166 back to its lowered position shown in FIG. 4A. During its downward travel toward its lowered position, the lifting plate 166 sequentially deposits the paper tray 138 back into its support tray opening 130, and then sequentially passes downwardly through the aligned turntable and shelf slots 90 and 62.

Utilizing the motor 72 (FIG. 3), the turntable structure 76 may be rotated to appropriately align any of the other three paper trays 100, 136 and 102 over the lifter structure 140 for movement of another paper tray upwardly to the picker roller assembly 28 in a manner which will now be described. Referring initially to FIGS. 5 and 5A, the paper tray 100 may be readied for lifting to the picker roller assembly by simply rotating the turntable structure 76 in a clockwise direction 90° away from its FIG. 4 position to thereby align the turntable slot 88 with the shelf slot 62 (FIG. 3).

Using the motor 122, the support tray 116 is shifted leftwardly from its FIG. 4 central position (as indicated by the arrow 184 in FIG. 5) to shift the support tray out of the vertical lift path of the paper tray 100. The lifter structure 140 may then be used to lift the tray 100 to the picker roller assembly 28 to permit the picker roller 36 to feed a desired number of paper sheets in the stack 42 held by tray 100 into the paper feed path 26. Tray 100 may then be lowered back into its turntable recess 96, and the support tray 116 be horizontally shifted to its central position in which portions of the support tray overlie and upwardly block portions of the two lower paper trays.

With the turntable structure 76 rotated 90° in a clockwise direction from its FIG. 5 position to the position thereof indicated in FIGS. 6 and 6A, the turntable slot 94 is brought into horizontal alignment with the shelf slot 44, and the tray 136 may be directly lifted to the picker roller assembly 28, using the lifter structure as previously described, and then lowered back into its support tray opening 128.

Finally, the turntable structure 76 may be rotated 90° in a clockwise direction from its FIG. 6 position to the position depicted in FIGS. 7 and 7A, and the support tray 116 shifted leftwardly as indicated by the arrow 186, to ready the paper tray 102 to be lifted to the picker assembly 28 and then lowered back into its shelf recess 98.

It can readily be seen from the foregoing that the paper feed system 12 of the present invention permits a large paper supply to be made available to the single picker roller assembly 28 in a vertically compact space (substantially shorter than a conventional four-deep stack of trays), despite the fact that four overlapping paper trays—two upper trays and two lower trays—are used. This unique multi-tray arrangement advantageously permits a large supply of a single type of paper to be used, thereby significantly lengthening the time between paper reloads, the use of four different paper types (such as copy paper, bond paper, letterhead and memo forms), or a desired paper type combination somewhere between these two extremes.

Access to a given tray, for paper reloading or paper type changeout is easily achieved simply by rotating the turntable structure until the desired paper tray faces the housing access opening 18 (FIG. 1), opening the access door 20, and then operating the motor 54 to horizontally move the shelf 44 to its dotted line access position shown in FIG. 1.

The foregoing detailed description is to be clearly understood as being given by way of illustration and example only, the spirit and scope of the present invention being limited solely by the appended claims.

What is claimed is:

1. For use in conjunction with an image reproduction machine, such as a printer or copier, having picker means operative to successively remove sheets of paper from a paper stack engaging an underside portion of said picker means, a paper feed system comprising:

a plurality of paper trays each adapted to hold a stack of paper sheets;

support means for supporting said plurality of paper trays, at levels lower than that of said picker means, in a circumferentially spaced array centered about a vertical axis extending through said support means and horizontally offset from said picker means, said support means being operative to support a first one of said plurality of paper trays in an overlying relationship with a second one of said plurality of paper trays;

means for rotating said plurality of paper trays about said vertical axis to move a selectively variable one of said plurality of paper trays into an underlying relationship with said picker means;

lifter means operative to lift the paper tray underlying said picker means from said support means in a manner bringing a paper stack held in the lifted paper tray into operative engagement with said picker means, and subsequently lower the lifted paper tray back onto said support means; and shifter means operable to temporarily shift said first one of said plurality of paper trays out of said overlying relationship with, and thus out of the vertical lift path of, said second one of said plurality of paper trays.

2. The paper feed system of claim 1 wherein:

said support means have opening means formed therein beneath said plurality of paper trays thereon, and said lifter means are positioned beneath said picker means, at a level lower than that of said support means, and are operative to be extended upwardly through said opening means to engage and lift the paper tray underlying said picker means.

3. The paper feed system of claim 1 wherein:

said plurality of paper trays include two lower paper trays, and two upper paper trays carried on said support means above said two lower paper trays.

4. The paper feed system of claim 3 wherein:

said two lower paper trays are positioned generally along a first horizontal line, and said two upper paper trays are positioned generally along a second horizontal line transverse to said first horizontal line.

5. A method of feeding paper to a picker assembly portion of an image reproduction machine such as a printer or copier, said method comprising the steps of:

horizontally supporting, in first vertical positions, a plurality of paper trays at levels lower than that of said picker assembly and in a circumferentially spaced array centered about a vertical axis horizontally offset from said picker assembly, each of said paper trays having a stack of paper sheets therein;

rotating said array of paper trays about said vertical axis to position a first selected one of said paper trays beneath said picker assembly;

lifting the first selected tray from its first vertical position to a second vertical position in which its associated paper stack is brought upwardly into engagement with an underside portion of said picker assembly;

lowering the lifted first selected paper tray to its first vertical position;

subsequently rotating said plurality of paper trays about said vertical axis to position a second selected one of said paper trays beneath said picker assembly;

lifting the second selected tray from its first vertical position to a second vertical position in which its associated paper stack is brought upwardly into engagement with an underside portion of said picker assembly; and lowering the lifted second selected paper tray to its first vertical position, said plurality of paper trays including a lower paper tray and an upper paper tray supported in an overlying relationship with said lower paper tray, and said method further comprising the step of temporarily shifting said upper paper tray out of its overlying relationship with said lower paper tray to permit said lower paper tray to be lifted to said picker assembly.

6. The method of claim 5 wherein:

said horizontally supporting step includes the step of supporting said plurality of paper trays on the upper side of a turntable member having a circumferentially spaced plurality of opening means extending upwardly therethrough and aligned with said plurality of paper trays, said rotating step is performed by rotating said turntable member about said vertical axis, and each of said lifting steps is performed by extending a lifter structure upwardly through the opening means associated with the selected paper tray.

7. The method of claim 6 wherein:

said horizontally supporting step further includes the step of rotatably supporting said turntable member on the top side of a horizontally movable shelf member having opening means, extending upwardly therethrough, with which each of said turntable member opening means may be rotated into overlying alignment with, and each of said lifting steps includes the step of extending said lifter structure upwardly through said shelf member opening means.

8. The method of claim 5 wherein:

said plurality of paper trays include two lower paper trays and two upper paper trays, and said horizontally supporting step includes the steps of supporting said two lower paper trays generally along a first horizontal line, and supporting said two upper paper trays above said two lower paper trays generally along a second horizontal line transverse to said first horizontal line.

9. An image reproduction machine comprising:

printing means for forming a predetermined image on a sheet of paper delivered thereto;

paper transport means for receiving a sheet of paper and delivering the received sheet of paper to said printing means;

picker means for successively removing sheets of paper from a paper stack brought upwardly into engagement with an underside portion thereof and delivering the removed paper sheets to said paper transport means; and a multiple tray rotary paper feed system including:

a plurality of paper trays each adapted to hold a stack of paper sheets, support means for supporting said plurality of paper trays, at levels lower than that of said picker means, in a circumferentially spaced array centered about a vertical axis extending through said support means and horizontally offset from said picker means, said support means being operative to support a first one of said plurality of paper trays in an overlying relationship with a second one of said plurality of paper trays, drive means for rotating said support means about said vertical axis to move a selectively variable one of said plurality of paper trays into an underlying relationship with said picker means, lifter means operative to lift the paper tray underlying said picker means from said support means in a manner bringing a paper stack held in the lifted paper tray into operative engagement with said picker means, and subsequently lower the lifted paper tray back onto said support means, and shifter means operable to temporarily shift said first one of said plurality of paper trays out of said overlying relationship with, and thus out of the vertical lift path of, said second one of said plurality of paper trays.

10. An image reproduction machine comprising:

printing means for forming a predetermined image on a sheet of paper delivered thereto;

paper transport means for receiving a sheet of paper and delivering the received sheet of paper to said printing means;

picker means for successively removing sheets of paper from a paper stack brought upwardly into engagement with an underside portion thereof and delivering the removed paper sheets to said paper transport means; and a multiple tray rotary paper feed system including:

a plurality of paper trays each adapted to hold a stack of paper sheets, means for horizontally supporting, in first vertical positions, said plurality of paper trays at levels lower than that of said picker means and in a circumferentially spaced array centered about a vertical axis horizontally offset from said picker means, means for rotating said array of paper trays about said vertical axis to sequentially position first and second selected ones of said plurality of paper trays beneath said picker means, and means operable to lift each selected paper tray, after it has been rotationally positioned beneath said picker means, upwardly to a second vertical position in which a paper stack held in the lifted paper tray is brought into operative engagement with an underside portion of said picker means, and then lower the lifted paper tray back to said first vertical position thereof, said plurality of paper trays including an upper paper tray and a lower paper tray, said means for horizontally supporting being operative to support said upper paper tray in an overlying relationship with said lower paper tray, and said image reproduction machine further comprising means for temporarily shifting said upper paper tray out of its overlying relationship with said lower paper tray to permit said lower paper tray to be lifted to said picker means.

11. The image reproduction machine of claim 10 wherein:

said means for horizontally supporting include a turntable member centered about said vertical axis and having a circumferentially spaced series of opening means extending vertically therethrough, and means for supporting said array of paper trays on the top side of said turntable member with each of said paper trays overlying a different one of said opening means, said means for rotating are operative to rotate said turntable about said vertical axis, and said means operable to lift each selected paper tray are positioned beneath said picker means and have a portion movable upwardly and then downwardly through each turntable member opening means when its associated paper tray is rotated into an underlying relationship with said picker means.

12. The image reproduction machine of claim 10 wherein:

said plurality of paper trays include two lower paper trays and two upper paper trays, and said means for horizontally supporting include means for supporting said two lower paper trays generally along a first horizontal line, and for supporting said two upper paper trays above said two lower paper trays generally along a second horizontal line transverse to said first horizontal line.

13. An image reproduction machine comprising:

a housing;

printing means, disposed in said housing, for forming a predetermined image on a sheet of paper delivered thereto;

paper transport means, disposed in said housing, for receiving a sheet of paper and delivering the received sheet of paper to said printing means;

picker means, stationarily supported within said housing, for successively removing sheets of paper from a paper stack brought upwardly into engagement with an underside portion thereof and delivering the removed paper sheets to said paper transport means; and a multiple tray rotary paper feed system positioned in said housing and including:

a plurality of upper paper trays each adapted to hold a stack of paper sheets, a plurality of lower paper trays each adapted to hold a stack of paper sheets, support means for supporting said upper and lower paper trays, at levels lower than that of said picker means, in a manner such that said upper and lower paper trays are in a circumferentially spaced array centered about a vertical axis horizontally offset from said picker means, with said lower paper trays positioned along a first horizontal line and said upper paper trays overlying said lower paper trays and extending along a second horizontal line perpendicular to said first horizontal line, means for rotating the supported paper trays about said axis to move a selectively variable one of said paper trays into an underlying relationship with said picker means, opening means extending vertically through said support means beneath the supported paper trays, lifter means disposed beneath said support means and operative to be extended upwardly through said opening means, lift the selected paper tray to bring a paper stack previously placed therein into operative engagement with an underside portion of said picker means, and subsequently lower the lifted paper tray back onto said support means, and means operable to temporarily shift said upper paper trays out of their overlying relationship with, and thus out of the lift path of, one of said lower paper trays.

14. The image reproduction machine of claim 13 wherein:

said support means include a turntable rotatable about said vertical axis, and means for mounting said paper trays on an upper side portion of said turntable for rotation therewith, said means for rotating the supported paper trays include means for rotating said turntable about said vertical axis, and said opening means include a circumferentially spaced series of openings extending vertically through said turntable and aligned with said paper trays.

15. The image reproduction machine of claim 14 wherein:

said support means include a support tray structure having a pair of openings, extending vertically therethrough, within which said upper paper trays are received and removably supported, said support tray structure openings defining a portion of said opening means, and means for mounting said support tray structure on said turntable, above said lower paper trays, for movement relative to said turntable parallel to said first horizontal line, and said means operable to temporarily shift include means for moving said support tray structure relative to said lower paper trays in said direction parallel to said first horizontal line.

16. The image reproduction machine of claim 15 wherein:

said housing has an access opening formed in a vertical side wall portion thereof, said support means further include a shelf member supported within said housing for horizontal sliding movement between a use position in which a rear side edge portion is disposed beneath said picker means, and an access position in which a front side edge portion of said shelf extends outwardly through said access opening, said rear side edge portion having an opening extending vertically therethrough, said lifter means being extendable upwardly through said shelf opening when said shelf is in said use position thereof, and said turntable is rotatably mounted on the top side of said shelf, for horizontal movement therewith, and positioned thereon in a manner such that each of said turntable openings may be selectively rotated into overlying alignment with said shelf opening.

17. The image reproduction machine of claim 13 wherein said lifter means include:

a plate member configured to be passed upwardly through said opening means, a plurality of elongated lifter members interconnected for scissors-like pivotal motion relative to one another between a lowered position in which said lifter members are in a generally horizontal orientation, and a raised position in which said lifter members are generally vertically disposed, means for connecting said lifter members to said plate member in a manner moving it upwardly through said opening means, into lifting engagement with the selected paper tray, as said lifter members are pivoted toward their raised position, and moving it downwardly through said opening means as said lifter members are pivoted toward their lowered position, and means for pivotally driving said lifter members between said raised and lowered positions thereof.

* * * * *

UNITED STATES PATENT AND TRADEMARK OFFICE

CERTIFICATE OF CORRECTION

PATENT NO. : 5,158,275

DATED : October 27, 1992

INVENTOR(S) : Charles A. Sellers and Steve J. Lau

It is certified that error appears in the above-identified patent and that said Letters Patent is hereby corrected as shown below:

Column 7, line 19, "portions" should be --portion--.

Signed and Sealed this

Eighteenth Day of January, 1994

*Attest:*

*Attesting Officer*

Bruce Lehman

BRUCE LEHMAN

*Commissioner of Patents and Trademarks*